US008635849B2

(12) United States Patent
Tassone et al.

(10) Patent No.: US 8,635,849 B2
(45) Date of Patent: Jan. 28, 2014

(54) METHOD AND SYSTEM FOR INTRODUCING FLUID INTO AN AIRSTREAM

(76) Inventors: Bruce A. Tassone, West Chester, PA (US); Wayne Tassone, Boothwynn, PA (US)

( * ) Notice: Subject to any disclaimer, the term of this patent is extended or adjusted under 35 U.S.C. 154(b) by 612 days.

(21) Appl. No.: 12/252,334

(22) Filed: Oct. 15, 2008

(65) Prior Publication Data

US 2009/0039182 A1 Feb. 12, 2009

Related U.S. Application Data

(62) Division of application No. 11/148,908, filed on Jun. 9, 2005, now Pat. No. 7,454,913.

(60) Provisional application No. 60/675,993, filed on Apr. 29, 2005.

(51) Int. Cl.

| | |
|---|---|
| ***B08B 9/00*** | (2006.01) |
| ***F16L 37/18*** | (2006.01) |
| ***F02C 7/00*** | (2006.01) |

(52) U.S. Cl.
USPC ..... 60/39.53; 285/316; 134/169 R

(58) Field of Classification Search
USPC ..... 134/169 A, 169; 60/755, 728; 285/276, 285/277, 314–316
See application file for complete search history.

(56) References Cited

U.S. PATENT DOCUMENTS

| | | | | |
|---|---|---|---|---|
| 2,736,578 | A * | 2/1956 | Rafferty | 285/91 |
| 3,439,943 | A * | 4/1969 | Thorne-Thomsen | 285/316 |
| 3,623,668 | A | 11/1971 | Freid et al. | 239/265.17 |
| 3,964,771 | A * | 6/1976 | Baudouin | 285/315 |
| 4,139,222 | A * | 2/1979 | Loland | 285/27 |
| 5,190,224 | A * | 3/1993 | Hamilton | 239/600 |
| 5,385,014 | A * | 1/1995 | Rathbun | 60/779 |
| 5,867,977 | A * | 2/1999 | Zachary et al. | 60/39.53 |
| 5,930,990 | A * | 8/1999 | Zachary et al. | 60/39.53 |
| 6,244,527 | B1 | 6/2001 | Ferrazza et al. | 239/600 |
| 6,553,768 | B1 * | 4/2003 | Trewin et al. | 60/772 |
| 6,820,430 | B1 | 11/2004 | Tassone et al. | 60/775 |
| 7,083,120 | B2 * | 8/2006 | Gilpatrick et al. | 239/397 |
| 2003/0140634 | A1 | 7/2003 | Daggett | 60/775 |
| 2006/0048796 | A1 * | 3/2006 | Asplund et al. | 134/21 |

OTHER PUBLICATIONS

Spraying Systems Co.® Industrial Spray Products—Catalog 70. Undated.

* cited by examiner

*Primary Examiner* — Gerald L Sung
(74) *Attorney, Agent, or Firm* — Woodcock Washburn, LLP

(57) ABSTRACT

A preferred of operating a gas turbine engine having an inlet for receiving a stream of air to be compressed includes providing a first and a second set of interchangeable spray nozzles. Each of the nozzles in the first set is capable of discharging fluid supplied to the nozzle at a first pressure at a first flow rate. Each of the nozzles in the second set is capable of discharging fluid supplied to the nozzle at the first pressure at a flow rate that is different from the first flow rate.

10 Claims, 12 Drawing Sheets

METHOD AND SYSTEM FOR INTRODUCING FLUID INTO AN AIRSTREAM

CROSS-REFERENCE TO RELATED APPLICATIONS

This application claims priority under 35 U.S.C. §120 to U.S. patent application Ser. No. 11/148,908 filed Jun. 9, 2005, now U.S. Pat. No. 7,454,913 B1 which issued Nov. 25, 2008, which in turn claims benefit of U.S. Provisional Patent Application Ser. No. 60/675,993 filed Apr. 29, 2005, now expired, the contents of which are incorporated by reference herein in their entirety.

TECHNICAL FIELD

The present invention relates to systems used to introduce fluid into an inlet airstream of rotating machinery such as gas turbine engines, for purposes such as washing, power augmentation, etc.

BACKGROUND

Rotating machinery, such as gas turbine engines, centrifugal compressors, steam turbines, etc., typically requires washing on a periodic basis. Washing is usually performed to remove dirt, dust, and other contaminates that collect along the flow path of the machine. Washes are usually conducted by injecting water or a liquid cleaning agent into the inlet airstream of the machine, so that the water or cleaning agent is ingested by the machine upon reaching the inlet thereof. Alternatively, the water or cleaning agent can be injected directly into the flow path within the machine.

Washes may be performed on an on-line basis, i.e., while the machine is operating. Alternatively, washes can be performed on an off-line basis, i.e., while the rotating components of the machine are spun at relatively low speed using the machine's starter or other suitable means; this type of wash is commonly referred to as a "crank wash."

Moreover, water or other types of heat-transfer media can be introduced into the inlet airstream of the machine, to increase the density of the inlet air and thereby augment the power of the machine.

The water or other fluid is usually introduced using a series of spray nozzles mounted upstream of the machine, on the bellmouth, inlet scroll, or other inlet structure. Spray nozzles can also be mounted on one or more casings of the machine itself, so that the spray nozzles extend into the flow path within the machine.

The spray nozzles and their associated mounting hardware are usually secured in place using welds, or other permanent or semi-permanent attachment means, to minimize the potential for the spray nozzles and mounting hardware to become detached. Detachment of a spray nozzle or its mounting hardware can result in catastrophic damage to the machine as the spray nozzle or mounting hardware travel downstream through the machine.

Mounting the spray nozzles and their associated mounting hardware using welds, or other permanent or semi-permanent connecting means, can make it difficult to remove and replace/reinstall the spray nozzles. Removal and replacement/reinstallation may be necessary when a nozzle requires cleaning or preventive maintenance, or when a different type of nozzle is required for a particular task.

For example, the disparate fluid pressures and flow rates associated with on-line and off-line washes usually necessitate the use of different spray nozzles for on-line and off-line washes. Switching between on-line and off-line nozzles can necessitate the time-consuming and labor-intensive process of breaking and subsequently re-forming welded connections. Alternatively, an installation may be configured to accommodate two separate sets of spray nozzles at the same time. The addition of a second set of spray nozzles requires additional space within the installation. The additional set of spray nozzles also requires an additional manifold or other means for delivering fluid to the additional spray nozzles, and additional mounting hardware.

SUMMARY

A preferred method for operating a gas turbine having an inlet for receiving a stream of air to be compressed comprises providing a first set of spray nozzles. Each of the nozzles in the first set is capable of discharging fluid supplied to the nozzle at a first pressure at a first flow rate. Each of the nozzles in the first set has a first portion of a quick-connect fitting coupled thereto.

The method also comprises providing a second set of spray nozzles. Each of the nozzles in the second set is capable of discharging fluid supplied to the nozzle at the first pressure at a flow rate that is different from the first flow rate. Each of the nozzles in the second set has a first portion of a quick-connect fitting coupled thereto.

The method also comprises mounting the first set of spray nozzles on a manifold located proximate the air inlet of the gas turbine. The manifold has mounted thereon a plurality of second portions of the quick-connect fittings that are coupled to the nozzles of the first and second sets. The first set of spray nozzles is mounted on the manifold by mating the first portion of the quick-connect fittings on the spray nozzles of the first set to the second portions of the quick-connect fittings on the manifold.

The method further comprises supplying a first fluid to the manifold so as to distribute the first fluid to each of the spray nozzles in the first set, whereby each of the spray nozzles of the first set discharge the first fluid into the air inlet of the gas turbine at the first flow rate, and removing the first set of nozzles from the manifold by separating the first and second portions of the quick-connect fittings.

The method further comprises mounting the second set of spray nozzles on the manifold by mating the first portion of the quick-connect fittings on the spray nozzles of the second set to the second portions of the quick-connect fittings on the manifold, and supplying a second fluid to the manifold so as to distribute the second fluid to each of the spray nozzles in the second set, whereby each of the spray nozzles of the second set discharge the second fluid into the air inlet of the gas turbine at a flow rate that is different from the first flow rate at which the spray nozzles from the first set discharged the first fluid.

A preferred embodiment of a kit for introducing a fluid into an inlet airstream of a gas turbine engine comprises a first spray nozzle configured to discharge the fluid at a first flow rate, and a second spray nozzle configured to discharge the fluid at a second flow rate different than the first flow rate. The kit also comprises a manifold capable of being mounted on an inlet structure upstream of the machine for directing the fluid to the first and second spray nozzles. The first and second spray nozzles can be interchangeably coupled to the manifold.

A preferred embodiment of a system for introducing a liquid into the inlet airstream of a gas turbine comprises a first set of spray nozzles. Each of the nozzles in the first set is configured to discharge the liquid at a first flow rate. The system also comprises a second set of spray nozzles. Each of the nozzles in the second set is configured to discharge the liquid at a second flow rate different than the first flow rate.

The system further comprises a manifold capable of directing the liquid to either one of the first and second sets of spray nozzles, and means for interchangeably coupling the first and second spray nozzles to the manifold, whereby the first set of nozzles can be readily replaced by the second set of nozzles if a different flow rate of liquid is desired.

BRIEF DESCRIPTION OF THE DRAWINGS

The foregoing summary, as well as the following detailed description of a preferred embodiment, are better understood when read in conjunction with the appended diagrammatic drawings. For the purpose of illustrating the invention, the drawings show an embodiment that is presently preferred. The invention is not limited, however, to the specific instrumentalities disclosed in the drawings. In the drawings.

DETAILED DESCRIPTION OF ILLUSTRATIVE EMBODIMENTS

The figures depict a preferred embodiment of a system 10 for injecting fluid into the inlet airstream of rotating machinery. The system 10 can be used, for example, to inject wash solution into the inlet airstream of rotating machinery such as a gas turbine engine 11, to perform engine washes. The system 10 can also be used to inject water into the inlet airstream of the engine 11, to augment the power of the engine 11. It should be noted that the use of the system 10 in connection with a rotating machine such as the gas turbine engine 11 is disclosed for exemplary purposes only. The system 10 can be used in connection with other types of rotating machinery, including centrifugal compressors, steam turbines, etc. The system 10 can also be used to direct fluid to the inlet airstream of the engine 11 (or other types of machinery) for purposes other than washing and power augmentation.

Figure 2:
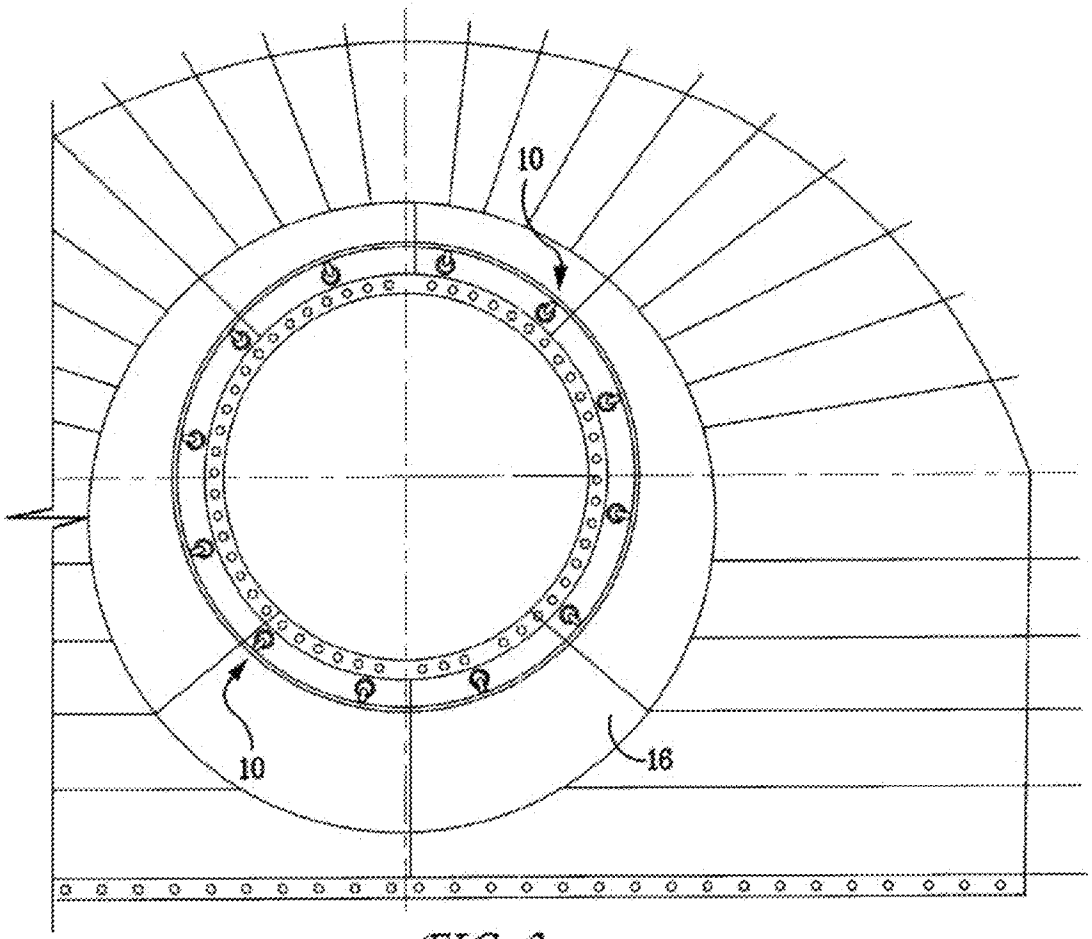
FIG. 2 is a front view of the system comprising the spray nozzle assembly shown in FIGS. 1A and 1B.
Figure 3B:
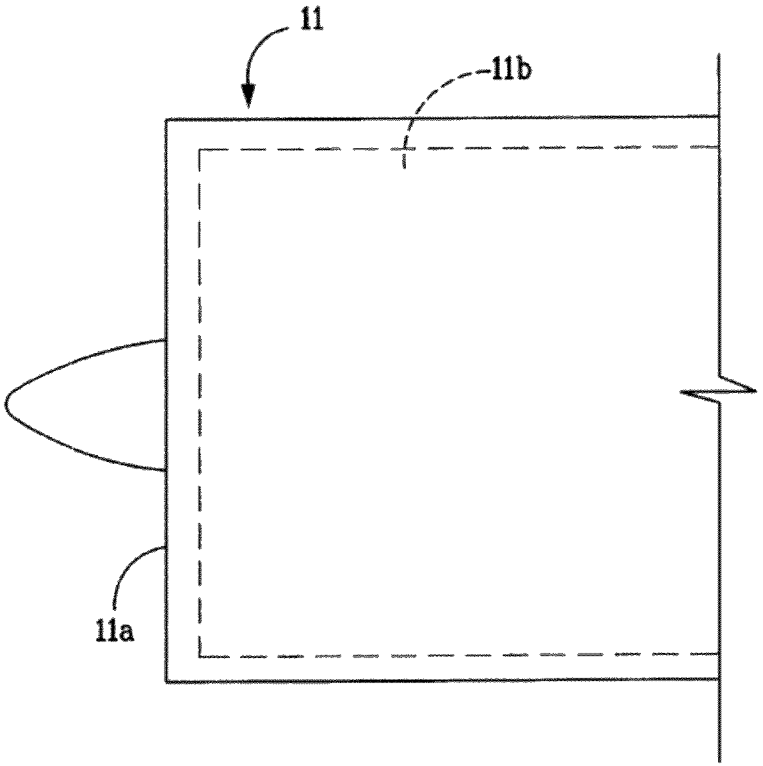
FIG. 3 is a side view of the system shown in FIG. 2.
Figure 3A:
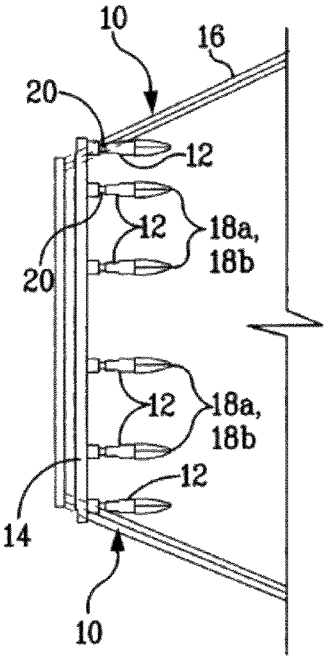

The system 10 includes a plurality of nozzle assemblies 12, and a manifold 14 (see FIGS. 2 and 3, the manifold 14 is not depicted in FIG. 2, for clarity). The nozzle assemblies 12 and the manifold 14 can be mounted on an inlet scroll 16 that helps guide the inlet airstream toward an inlet 11*a* of the engine 11. The inlet airstream enters a compressor 11*b* of the engine 11, after reaching the inlet 11*a*. The compressor 11*b* compresses the air. The air subsequently enters a combustor (not shown) of the engine 11, where the air is mixed with fuel and burned. The resulting combustion gases enter a turbine (also not shown). The turbine 11*d* is coupled to the compressor 11*b* by a shaft. The turbine 11*d* extracts energy from the combustion gases, and drives the compressor by way of the shaft.

Figure 1A:
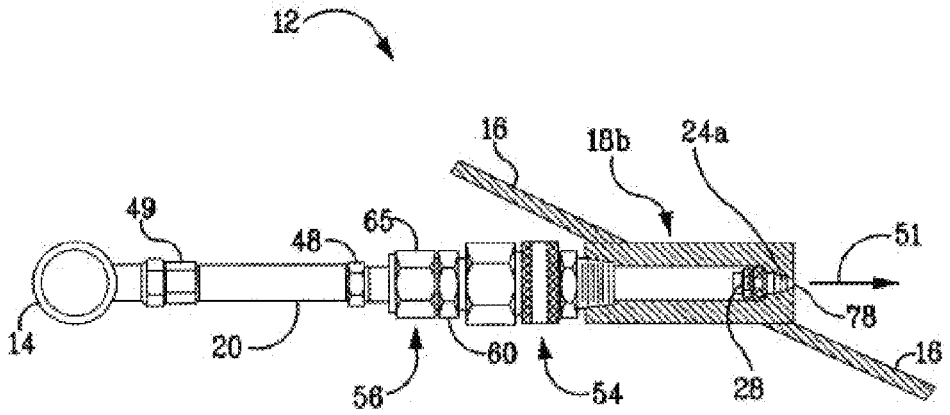
FIG. 1A is a side view of a spray nozzle assembly of a preferred embodiment of a system for injecting fluid into an inlet airstream of rotating machinery, depicting the spray nozzle assembly mounted on a mounting boss on an inlet scroll.

Each nozzle assembly 12 is accommodated by an associated mounting boss 18*a* (FIG. 1B) or, alternatively, a mounting boss 18*b* (FIG. 1A). The mounting bosses 18*a*, 18*b* are mounted on the inlet scroll 16 by a suitable means such as welding. The differences between the mounting bosses 18*a*, 18*b* are discussed below.

The system 10 is described in connection with the inlet scroll 16 for exemplary purposes only. The system 10 can be used with other types of inlet structures, such as an inlet plenum or a bellmouth. In other words, the mounting bosses 18*a*, 18*b* can be mounted on other types of inlet structures in other applications of the system 10.

Each nozzle assembly 12 is in fluid communication with the manifold 14 by way of an associated section of tubing 20 coupled to the manifold 14 and the nozzle assembly 12. Pressurized fluid is supplied the manifold 14 by a pump (not shown). The fluid flows through the manifold 14, and reaches each nozzle assembly 12 by way of the tubing 20. The nozzle assemblies 12 discharge the fluid into the inlet airstream, so that the fluid can be carried downstream, into the engine 11.

The fluid supplied to the manifold 14 can be a suitable engine wash solution or water, when the system 10 is used to perform engine washes. For example, the fluid can be R-MC, POWERBACK, or RELION engine wash solution, available from ECT, Inc. of Bridgeport, Pa. Water or other suitable fluid can be supplied to the manifold 14 when the system 10 is used for power augmentation.

Figure 10:
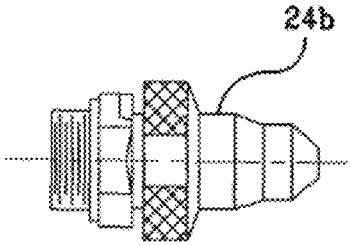
FIG. 10 is a side view of an alternative embodiment of a spray nozzle of the spray nozzle assembly shown in FIGS. 1A thru 7.

Each nozzle assembly 12 comprises a first spray nozzle (spray tip) 24*a*, and a substantially cylindrical nozzle body 26. Each nozzle assembly 12 optionally can include a second spray nozzle 24*b* configured for operation at a different fluid pressure and flow-rate than the first spray nozzle 24*a* (see FIG. 10). For example, the first spray nozzle 24*a* can be configured for the flow rate and pressure required during an on-line wash, i.e., a wash performed while the engine 11 is operating. The second spray nozzle 24*b* can be configured for the lower flow rate and pressure associated with an off-line, or crank wash. A crank wash typically is performed while the engine 11 is not operating, and while the rotating components of the engine 11 are rotated at a relatively low velocity by, for example, the engine starter. The first and second spray nozzles 24*a*, 24*b* are interchangeable, as discussed below.

The system 10 can include additional spray nozzles (not shown) configured for operation at a different fluid pressure and flow-rate than the first and second spray nozzles 24*a*, 24*b*. The additional spray nozzles can be configured, for example, to operate at the pressure and flow rate associated with water injection used for power augmentation. The additional spray nozzles can be configured to be interchangeable with the first and second spray nozzles 24*a*, 24*b*. The following comments regarding the first and second spray nozzles 24*a*, 24*b* apply equally to any additional spray nozzles included with the nozzle assemblies 12, unless otherwise noted.

The first and second spray nozzles 24*a*, 24*b* can be any suitable spray nozzles capable of producing the required spray pattern in the inlet airstream, and capable of operating at the required flow rate and pressure for a particular application. For example, spray nozzles suitable for use as the first and second spray nozzles 24*a*, 24*b* can be obtained from Spraying Systems Co. of Wheaton, Ill. as the QUICKJET spray nozzle. The optimal spray pattern for the first and second spray nozzles 24*a*, 24*b* is application dependent, and can vary with factors such as the flow rate and velocity of the inlet airstream, the distance between the first and second spray nozzles 24*a*, 24*b* and the inlet 11*a*, etc. A particular spray pattern therefore is not specified herein.

The first and second spray nozzles 24*a*, 24*b* are substantially identical, with the exception discussed below. The following description therefore applies equally to the second spray nozzle 24*b*, unless otherwise stated.

Figure 5:
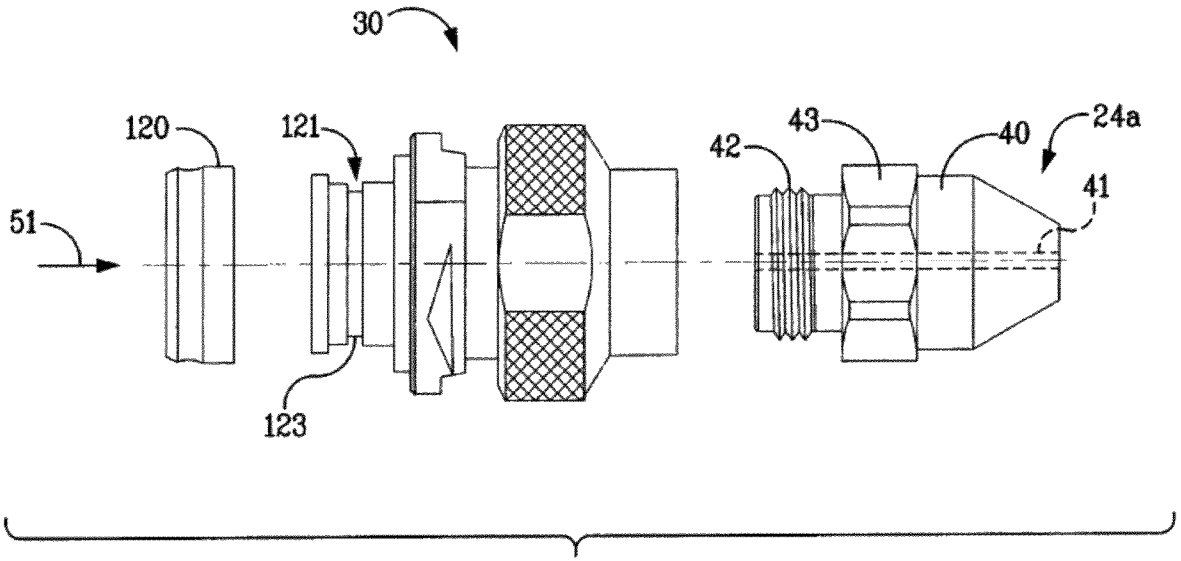
FIG. 5 is an exploded side view of a spray nozzle, and a male portion of a quick-connect fitting of the spray nozzle assembly shown in FIGS. 1A thru 4.
Figure 6:
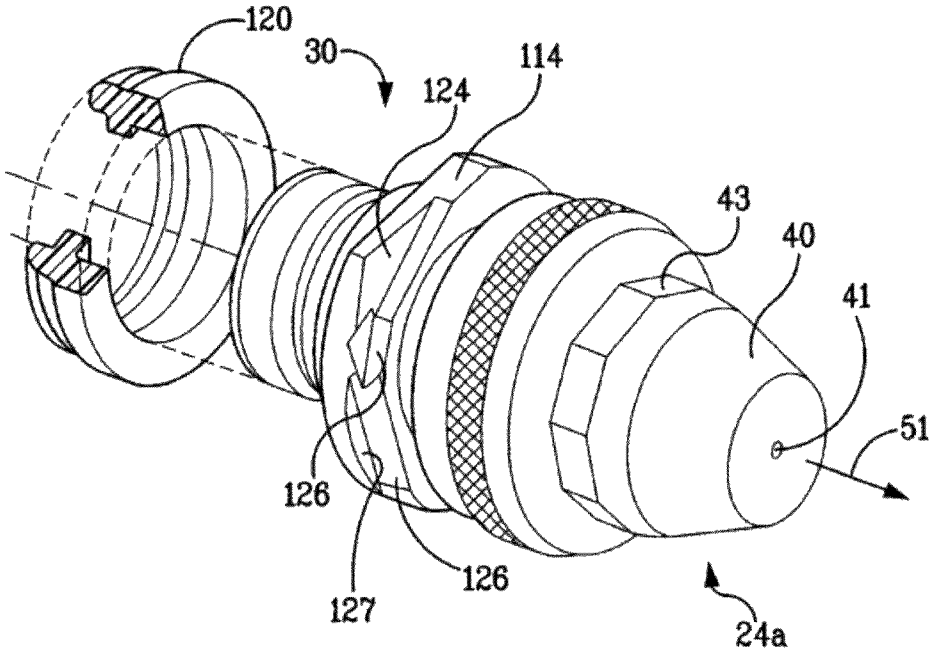
FIG. 6 is a perspective view of the spray nozzle and male portion of the quick-connect fitting of the spray nozzle assembly shown in FIGS. 1A thru 5.

The first spray nozzle 24*a* comprises a body 40 (see FIGS. 5 and 6). The body 40 has an axial bore, or orifice 41 formed therein for directing fluid through spray nozzle 24*a*. The orifice 41 of the second spray nozzle 24*b* is sized differently than the orifice 41 of the first spray nozzle 24*a*, to accommodate the different fluid pressure and flow rate associated with the second spray nozzle 24*b*.

The first spray nozzle 24*a* also includes a threaded portion 42 and a hexagonal portion 43 that each adjoin the body 40. The threaded portion 42 facilitates mounting of the first spray nozzle 24*a*. The hexagonal portion 43 facilitates tightening of the first spray nozzle 24*a* during mounting, using a wrench or other suitable means.

Preferably, the first and second spray nozzles 24*a*, 24*b* are coupled to the nozzle body 26 by a quick-connect fitting 28 comprising a male portion 30 and a female portion 32 (see FIGS. 4 thru 7). A quick-connect fitting suitable for use as the quick-connect fitting 28 can be obtained, for example, from Spraying Systems Co.

The male portion 30 of the quick-connect fitting 28 can be secured to the first spray nozzle 24*a* by a suitable means such as internal threads formed on the male portion 30 (not shown), for engaging the threaded portion 42 of the first spray nozzle 24*a*.

The first spray nozzle 24*a* and the male portion 30 can be further secured by welding or other suitable means, to help ensure that the first spray nozzle 24*a* does not separate from the male portion 30. Another male portion 30 can be secured to the second spray nozzle 24*b*, in a substantially identical manner.

Figure 7:
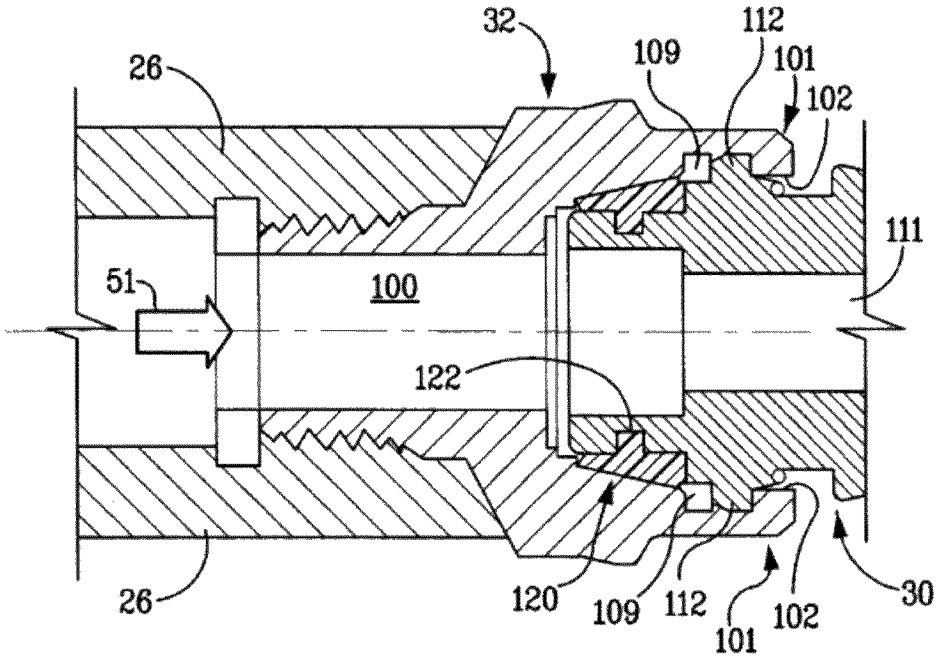
FIG. 7 is a cross-sectional side view of the male portion and a female portion of the quick-connect fitting, and a nozzle body of the spray nozzle assembly shown in FIGS. 1A thru 6.

The female portion 32 can be secured to the nozzle body 26, proximate a first end thereof, by a suitable means such as external threads formed on the female portion 32, and complementary threads on the nozzle body 26 (see FIG. 7). The female portion 32 and the nozzle body 26 can be further secured by welding or other suitable means, to help ensure that the female portion 32 does not separate from the nozzle body 26.

The relative positions of the male and female portions 30, 32 can be reversed in alternative embodiments. In other words, a male portion 30 can be secured to the nozzle body 26, and respective female portions 32 can be secured to the first and second spray nozzles 24*a*, 24*b* in the alternative.

The female portion 32 of the quick-connect fitting 28 has a bore 100 formed therein. The bore 100 is defined, in part, by two diametrically-opposed flanges 101. Each flange 101 has a substantially planar, inwardly-facing surface 102. The surfaces 102 help to define a downstream end of the bore 100. (The direction of flow through the various components of the system 10 is denoted by the arrows 51 in the figures.) Each flange 101 has a circumferentially-extending, inwardly-facing slot 109 formed therein. The bore 100 helps to facilitate mating of the male and female portions 30, 32. The bore 100 also facilitates the flow of fluid through the female portion 32.

The male portion 30 of the quick-connect fitting 28 can include a body 110, and two diametrically-opposed lugs 112 formed on the body 110. The body 110 has a bore, or orifice 111 formed therein for directing fluid from the bore 100 of the female portion 32, to the orifice 41 of the associated spray nozzle 24*a*, 24*b*.

Each lug 112 includes an outwardly-facing, substantially planar surface 114. The surfaces 114 are spaced so that the lugs 112 can be inserted between the surfaces 102 and into the bore 100, so that each lug 112 substantially aligns with a corresponding slot 109.

The quick-connect fitting 28 can include a biasing seal member 120. The biasing seal member 120 can be mounted on a shoulder 121 of the male portion 30. The biasing member 120 has a rib 122 formed thereon (see FIG. 7). The shoulder 121 has a groove 123 formed therein for receiving the rib 122 (see FIG. 5). The rib 122 helps to retain the biasing member 120 on the shoulder 121.

Each lug 112 preferably includes a pair of diametrically-substantially planar camming surfaces 124 (see FIG. 6). Each camming surface 124 extends radially outward, i-e., away from the axial centerline of the male portion 30. Each camming surface 124 also extends at an acute angle, e.g., 30°, in relation the axis of the male portion 30. The camming surfaces 124 each have a substantially triangular shape. Rotating the male portion 30 in the clockwise direction (from the perspective of FIG. 6) once lugs 112 have been aligned with the slots 109 causes the portions of the camming surfaces 124 adjacent the outer ends of the camming surfaces 124 to come into contact with an associated one of the flanges 101. Continued rotation of the male portion 30, through an angular displacement of approximately 60°, causes the camming surfaces 124 to draw the male portion 30 toward the female portion 32.

The biasing seal member 120 is positioned so the movement of the male portion 30 toward the female portion 32 compresses the biasing seal member 120. The biasing seal member 120 helps to seal the interface between the male and female portion 30, 32. Moreover, the resilient deflection of the biasing seal member 120 causes the biasing seal member to exert an axial biasing force that acts on the male and female portions 30, 32, in opposing directions.

The lugs 112 preferably have substantially planar detent surfaces 126 formed thereon (see FIG. 6). The detent surfaces 126 are positioned at a common axial location with a first, or inner side 126 of the associated camming surface 124. Rotation of the male portion 30 in relation to the female portion 32 by approximately 60° causes the detent surfaces 126 to engage the flanges 101, thereby establishing the further extent of inward movement of the male portion 30 into the female portion 32, against the bias of the biasing seal member 120.

The lugs 112 can also include locking surfaces 128. The locking surfaces 128 are axially offset from the detent surfaces 126. Rotation of the male portion 30 in relation to the female portion 32 by approximately 90° causes the detent surfaces 126 to pass completely over the flanges 101, so that the locking surfaces 128 can drop into engagement with the associated flanges 101 with a snap action. Walls 127 associated with each locking surface 128 contact associated ones of the flanges 101 at this point, thereby preventing further rotation of the male portion 30. As the locking surfaces 128 are axially offset from the detent surfaces 126 at this point, contact between the flanges 101 and the associated detent 126 can prevent rotation of the male portion 30 in the reverse direction, thereby securing the male portion 30 to the female portion 32.

The quick-connect fitting 28 thus permits the first and the second spray nozzles 24*a*, 24*b* to be securely mated to the nozzle body 26 with relative ease, without a need for threaded or welded connections. Moreover, the quick-connect fitting 28 facilitate removal of the first and the second spray nozzles 24*a*, 24*b* from the nozzle body 26 without a need to break any threaded or welded connections.

Further details of a quick-connect fitting suitable for use as the quick-connect fitting 28 can be found in U.S. Pat. No. 6,244,527, the contents of which is incorporated by reference herein in its entirety.

It should be noted that other types of quick-connect fittings can be used in lieu of the quick-connect fitting 28. For example, quick-connect fittings that utilize springs to bias a male and a female portion into engagement can be used instead of the quick-connect fitting 28. As a further example, quick-connect fittings that incorporate configurations of camming surfaces and/or biasing seal members different than those of the quick-connect fitting 28 can also be used in the alternative.

Figure 1B:
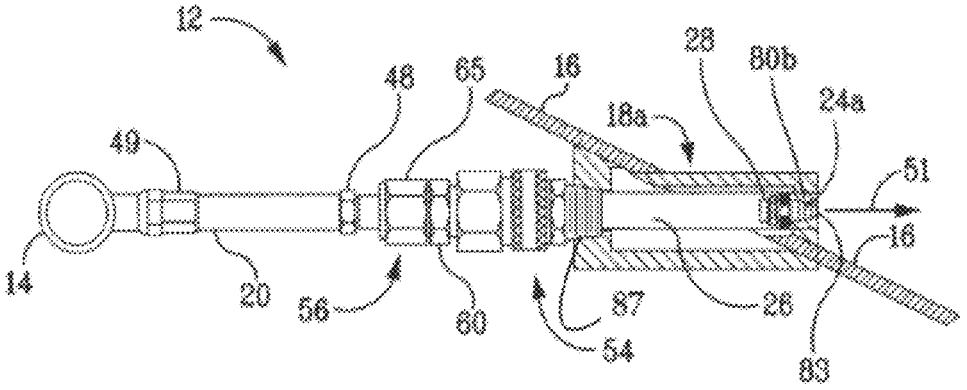
FIG. 1B depicts an alternative mounting configuration for the spray nozzle assembly shown in FIG. 1A.
Figure 4:
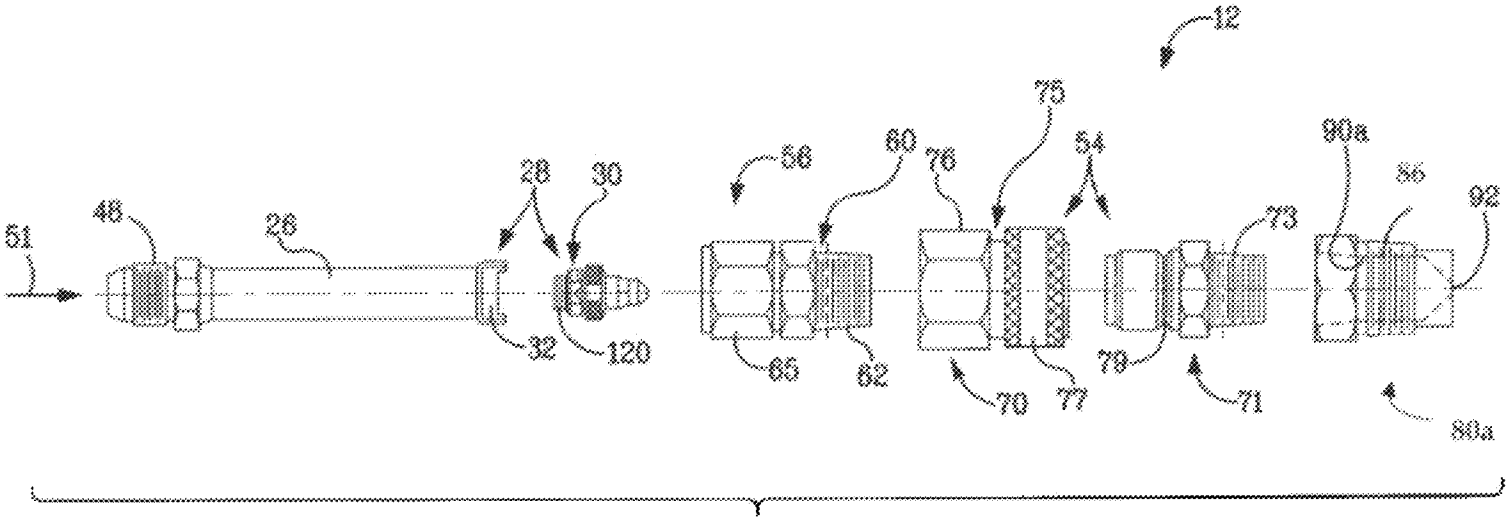
FIG. 4 is an exploded side view of the spray nozzle assembly shown in FIGS. 1A thru 3.

Each nozzle assembly 12 also comprises a fitting 48 (see FIGS. 1A, 1B, and 4). The fitting 48 is secured to a second end of the nozzle body 26 by a suitable means such as welding. The fitting 48 can be, for example, a ⅝-inch NPT or JIC fitting (the fitting 48 is depicted as a JIC fitting in the figures for exemplary purposes only). The fitting 48 can be used to couple the nozzle assembly 12 to its associated length of tubing 14 by way of a complementary fitting 49 on the tubing 14.

Figure 13:
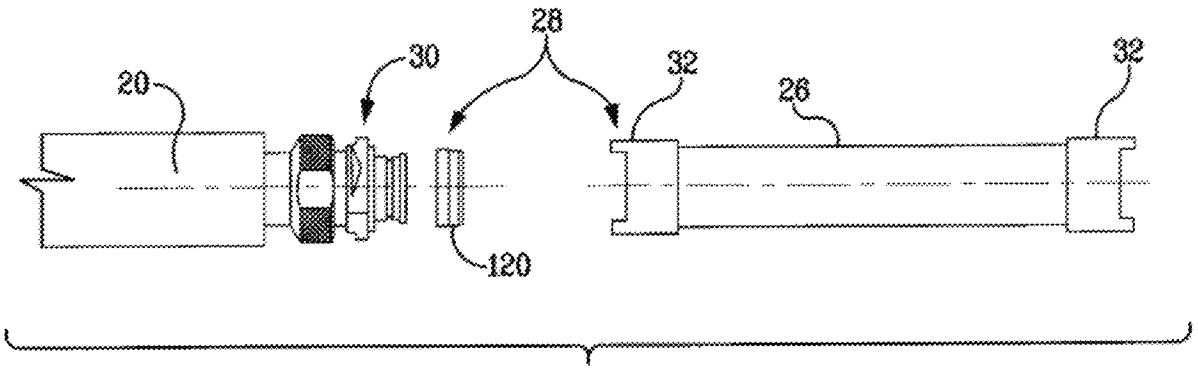
FIG. 13 is a side view of an alternative mounting configuration for the spray nozzle assembly shown in FIGS. 1A thru 7, 11, and 12.

A suitable quick-connect fitting, such as the quick-connect fitting 28, can be used in lieu of the fitting 48 and the associated fitting on the tubing 14 in alternative embodiments of the system 10, as shown in FIG. 13.

It should be noted that dimensions of the various components of the system 10 are application dependent, and can vary with factors such as the required flow rate and pressure of the fluid being injected by the system 10; specific dimensions are presented herein for exemplary purposes only.

Figure 8:
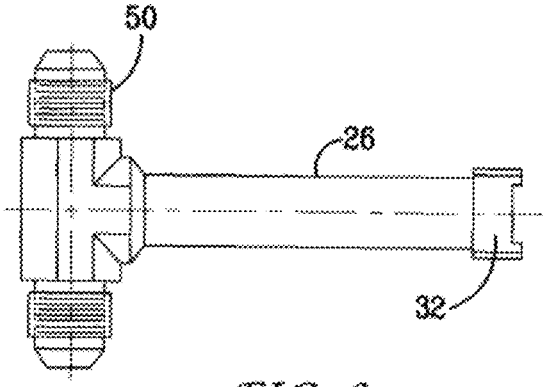
FIG. 8 is a side view of an the nozzle body of the spray nozzle assembly shown in FIGS. 1A thru 7, depicting an alternative mounting arrangement for the nozzle body.

Each nozzle assembly 12 can have a fitting 50 secured thereto in lieu of the fitting 48 in alternative embodiments of the system 10 (see FIG. 8). The fitting 50 can accommodate two lengths of tubing that couple the nozzle assembly 12 to its adjacent nozzle assemblies 12. The use of the fittings 50 and associated tubing can obviate the need for the manifold 14 to direct the pressurized fluid to the nozzle assemblies 12. In other words, the lengths of tubing between each adjacent pair of fittings 50 collectively can form a manifold, in lieu of the manifold 14.

The nozzle assembly 12 also comprises a quick-connect fitting in the form of a coupling 54, and a compression fitting 56. The compression fitting 56 secures the coupling 54 to the nozzle body 26. The coupling 54 removably couples the compression fitting 56, the nozzle body 26, and the attached spray nozzle 24*a*) to the mounting boss 18*a* or 18*b*.

The compression fitting 56 includes a body 60 having a bore 61 formed therein (see FIGS. 1A, 1B, 4, and 12). The bore 61 is sized so that the nozzle body 26 can fit within the bore 61 with minimal clearance between the outer surface of the nozzle body 26, and the circumference of the bore 61. The body 60 has a first and a second set of external threads 62, 63 formed thereon.

The compression fitting 56 also includes a nut 65, and ferrule 66, and an annular seat 67. The nut 65 has internal threads (not shown) that engage the threads 63 on the body 60. The ferrule 66 is positioned within the nut 65 so that a first end of the ferrule 66 contacts the upstream end of the body 60. The seat 67 is disposed between a second end of the ferrule 66—and the nut 65, so that tightening of the nut 65 on the body 60 urges the ferrule toward the body 60.

The surface of the body 60 that defines the upstream end of the bore 61 is tapered. The ferrule 66 has a frustoconical shape, so that the outer surface of the ferrule 66 substantially matches the taper of the bore 61. The ferrule 66 therefore is compressed radially inward, toward the nozzle body 26, as the nut 65 is tightened. The compression of the ferrule 66 between the body 60, nut 65, and nozzle body 26 secures the body 60 to the nozzle body 26.

Specific details of the compression fitting 56 are presented for exemplary purposes only. Other types of compression fittings, including single-piece compression fittings, can be used in lieu of the compression fitting 56 in alternative embodiments.

The coupling 54 comprises a plug 70, and a socket 71 for receiving the plug 70 (see FIGS. 1A, 1B, 4, and 11). The plug 70 has an axially-extending passage 81 formed therein for receiving-the nozzle body 26. The plug 71 mates with a corresponding mounting boss 18*a* or 18*b* on the inlet scroll 16. In particular, the plug 70 preferably has NPT threads 73 formed on an exterior thereof. The mounting boss 18*a*, 18*b* has a through hole formed in a rearward end thereof. The through hole has complementary threads formed along a circumference thereof for engaging the threads 73 on the plug 70, thereby securing the plug 71 on the mounting boss 18*a* or 18*b*.

The socket 71 comprises a body 75. The body 75 includes a hexagonal portion 76 having internal threads (not shown) formed therein. The threads within the hexagonal portion 76 engage the threads 62 on the body 60 of the compression fitting 54, to secure the compression fitting 54 to the socket 71.

The socket 71 also includes a collar 77. The collar 77 is positioned around the body 75, downstream of the hexagonal portion 76. The collar 77 can move axially in relation to the body 75, between a first (downstream) position shown in the figures, and a second position. The collar 77 is biased toward the first position by a spring (not shown).

Figure 11:
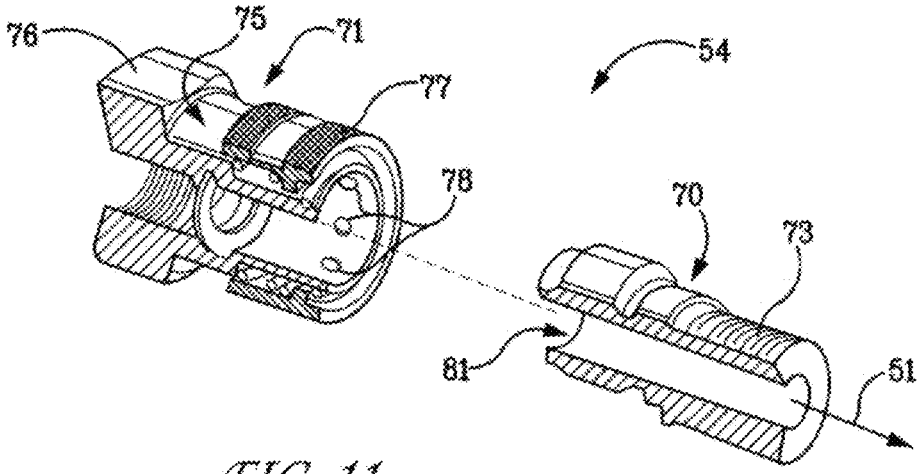
FIG. 11 is a perspective view of a coupling of the spray nozzle assembly shown in FIGS. 1A thru 7, showing a plug of the coupling in cross-section.
Figure 12:
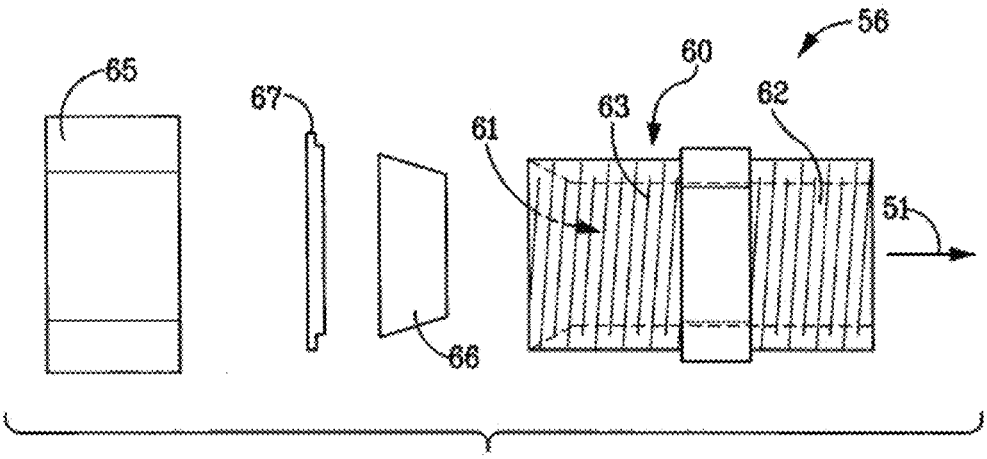
FIG. 12 is a side view of a compression fitting of the spray nozzle assembly shown in FIGS. 1A thru 7 and 11, showing a plug of the coupling in cross-section.

The socket also includes a plurality of ball bearings 78 (see FIG. 11). The ball bearings 78 are disposed corresponding bores formed in the body 75. The bores are formed beneath the collar 77, so that the collar 77 contacts the ball bearings 78 and urges the ball bearings 78 radially inward when the collar 77 is in its first position.

The plug 70 has a circumferentially-extending groove 79 formed therein (see FIG. 4). The groove 79 substantially aligns with the ball bearings 78 when the plug 70 is inserted in the socket 71. The collar 77 urges the ball bearings 78 into the groove 79 when the collar 77 is in its first position. Contact between the ball bearings 78 and the surface of the groove 79 prevents separation of the plug 70 and the socket 71. The collar 77 releases the ball bearings 78 when the collar 77 is moved to is second position, so that the plug 70 and the socket 71 can be separated by pulling the socket 71 away from the plug 70 in the axial direction. The plug 70 and the socket 71 thus can be separated with relative ease, without a need to unscrew any threaded fittings. The plug 70 can be mated with the socket 71 by retracting the collar 77 to the second position, inserting the plug 70 into the socket, and releasing the collar 77.

A coupling suitable for use as the coupling 52 can be obtained, for example, from Parker Hannefin Corp. Specific details of the coupling 52 are presented for exemplary purposes only. Other types of quick-connect fittings can be used in lieu of the coupling 52 in alternative embodiments.

The socket 71 of the coupling 54, the compression fitting 56, the nozzle body 26, the fitting 48, and the first or second spray nozzles 24*a*, 24*b* form an assembly that can be secured to and removed from an associated mounting boss 18*a* or 18*b* as a single unit, as discussed below.

A retainer 80*a* can be installed on the mounting boss 18*a* (see FIG. 4). Alternatively, a retainer 80*b* can be installed on the mounting boss 18*a* (see FIGS. 1B and 9). The retainers 80*a*, 80*b* can receive either of the nozzle tips 24*a* or 24*b*.

The mounting boss 18*a* has a penetration 83 formed in a forward end thereof, for receiving the retainer 80*a* or, alternatively, the retainer 80*b*. The surface of the mounting boss 18*a* that defines the penetration 83 is shaped to substantially match the exterior profile of the retainer 80*a* or, alternatively, the retainer 80*b*.

Threads 87 can be formed around the circumference of the penetration 83, when the mounting boss 18*a* is configured to receive the retainer 80*a*. The threads 87 can engage complementary threads 86 formed on the exterior of the retainer 80*a*, to mate the retainer 80*a* with the mounting boss 18*a*.

The circumference of the penetration 83 can be formed without threads when the mounting boss 18*a* is configured to accommodate the retainer 80*b*, as shown in FIG. 1B. The retainer 80*b* has a flange 89 formed thereon that permits the retainer 80*b* to be secured to the mounting boss 18*a* by bolts 88. The forward end of the mounting boss 18*a* can include threaded holes that accommodate the bolts 88 used to secure the retainer 80*b* to the mounting boss 18*a*.

Alternative embodiments of the retainers 80*a*, 80*b* (not shown) can be secured to the mounting boss 18*a* by welding or other suitable means.

Figure 9:
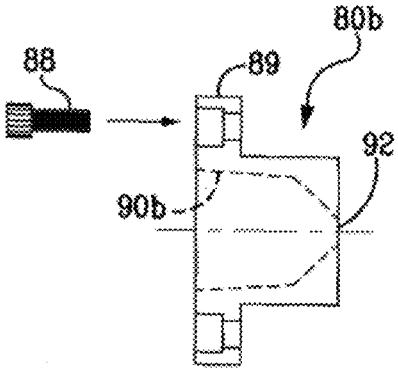
FIG. 9 is a side view of an alternative embodiment of a retainer used to mount the spray nozzle assembly shown in FIGS. 1A thru 7.

The retainers 80*a*, 80*b* have respective interior surfaces 90*a*, 90*b* (see FIGS. 4 and 9). The interior surfaces 90*a*, 90*b* each have a shape that substantially matches the shape of the respective first and second spray nozzles 24*a*, 24*b*. Each retainer 80*a*, 80*b* has a hole 92 formed in a forward end thereof, to provide an outlet for the fluid discharged by the first and second spray nozzles 24*a*, 24*b*.

The mounting boss 18*b* can be used in the alternative to the mounting boss 18*a* (see FIG. 1A). The mounting boss 18*b* facilitates mounting of the nozzle assembly 12 without the use of retainers such as the retainers 80*a*, 80*b*. A forward end of the mounting boss 18*b* has a penetration 78 formed therein. The surface of the penetration 78 is shaped to substantially match the exterior profile of the first and second spray nozzles 24*a*, 24*b*.

The penetrations 83, 78 formed in the respective mounting bosses 18*a*, 18*b* are shaped to prevent the nozzle assembly 12, or any of the individual components thereof, from accidentally traveling downstream past the inlet scroll 16 and entering the inlet airstream.

Each nozzle assembly 12 can be installed on the inlet scroll 16 as follows. The retainers 80*a*, 80*b*, or another type of retainer can be mounted on the forward end of the mounting boss 18*a*. (The system 10 can be used without a retainer, as discussed above.) The plug 70 of the coupling 54 can be mated with the rearward end of the mounting boss 18*a* or 18*b*.

The socket 71 of the coupling 54, the compression fitting 56, the nozzle body 26, the fitting 48, and the first or second spray nozzles 24*a*, 24*b* can be mated to form an assembly that can be secured to and removed from an associated mounting boss 18*a*, 18*b* and retainer 80*a*, 80*b* as a single unit. The assembly can be mounted on an associated mounting boss 18*a*, 18*b* and retainer 80*a*, 80*b* by inserting the nozzle body 26 and the first or second spray nozzles 24*a*, 24*b* of the assembly 68 into the mounting boss 18*a* or 18*b*, by way of the through hole formed in the rearward end of the mounting boss 18*a*, 18*b*. The socket 71 of the coupling 54 (and the remainder of the assembly 68) can be secured to the mounting boss 18*a* or 18*b* by mating the socket 71 with the plug 70 in the above-noted manner. As discussed above, the use of a quick-connect fitting such as the coupling 54 permits the assembly to be securely mounted with relative ease, without a need to break any threaded, flanged, welded, or other connections.

The first and second spray nozzles 24*a*, 24*b* therefore can be accessed with relative ease, and without a need to break any threaded, flanged, welded, or other connections besides the connection between the socket 71 and the plug 70. The quick-connect fitting 28 that couples each of the first and second spray nozzles 24*a*, 24*b* permits the first and second spray nozzles 24*a*, 24*b* to be removed from the nozzle body 26 and replaced without the need to break any threaded or welded connections. Hence, the first and second spray nozzles 24*a*, 24*b* can be removed for cleaning, repair, or maintenance, and can be reinstalled or replaced with a substitute, with a minimal outlay of time and effort.

Moreover, the first and second spray nozzles 24*a*, 24*b* are each equipped with the male portion 30 of the quick-connect fitting 28, and therefore are interchangeable. Hence, the first and second spray nozzles 24*a*, 24*b* can be swapped with a minimal outlay of time and effort, to reconfigure the system 10 for on-line and off-line washes, power augmentation, etc. The interchangeability of the first and second spray nozzles 24*a*, 24*b*, and the relative ease with which the first and second spray nozzles 24*a*, 24*b* can be changed, can obviate the need for separate manifolds for on-line and off-line washes.

The foregoing description is provided for the purpose of explanation and is not to be construed as limiting the invention. While the invention has been described with reference to preferred embodiments or preferred methods, it is understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are with the scope of the appended claims. Those skilled in the relevant art, having the benefit of the teachings of this specification, may effect numerous modifications to the invention as described herein, and changes may be made without departing from the scope and spirit of the invention as defined by the appended claims.

Figure 14:
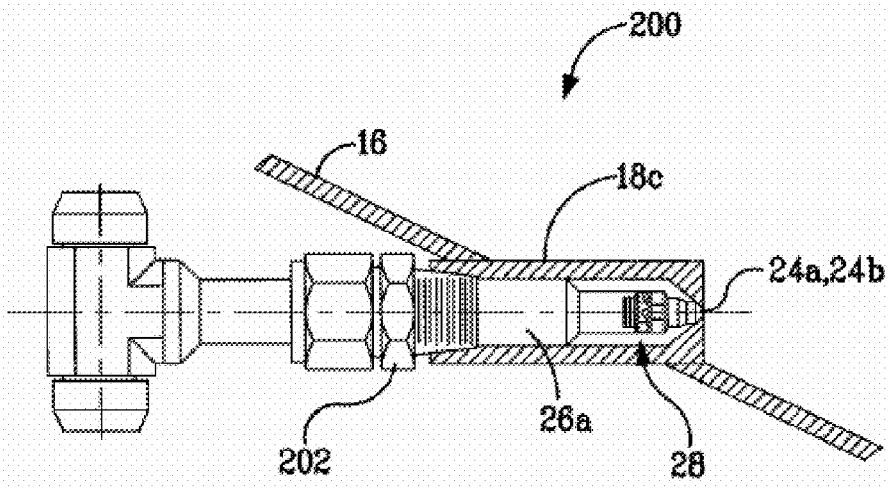
FIG. 14 is a side view of an alternative embodiment of the spray nozzle assembly shown in FIGS. 1A thru 7, 11, and 12.

For example, FIG. 14 depicts an alternative embodiment of the spray nozzle assembly 12, in the form of a spray nozzle assembly 200. The spray nozzle assembly 200 can include one of the first spray nozzles 24*a* and, optionally, one of the second spray nozzles 24*b*. The spray nozzle assembly 200 can also include a nozzle body 26*a*, and a quick-connect fitting such as the quick-connect fitting 28, for removably securing the first and second spray nozzles 24*a*, 24*b* to the nozzle body 26*a*. The spray nozzle assembly 200 can be mounted on a mounting boss 18*c*. The spray nozzle assembly 200 can include a JIC or other suitable fitting 202 for securing the nozzle assembly 200 to the boss 18*c*.

Figure 15B:
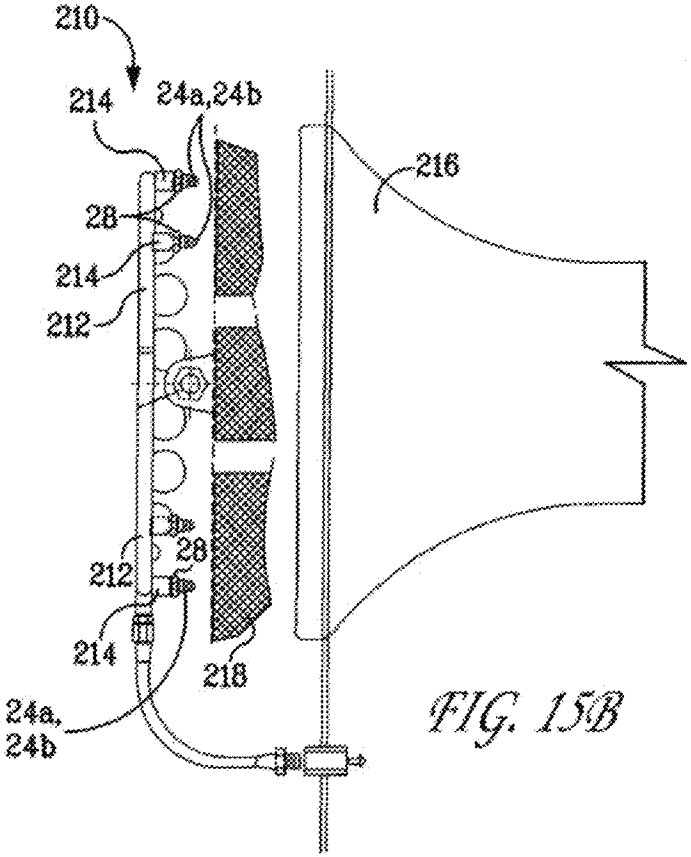
FIG. 15B is a side view of the alternative embodiment shown in FIG. 15A.
Figure 15A:
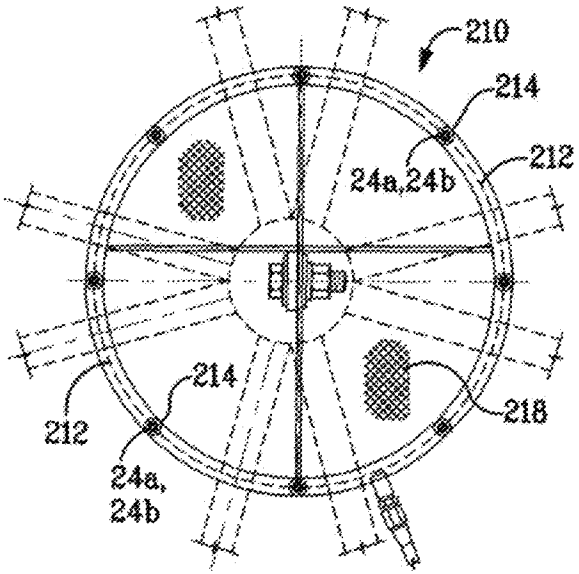
FIG. 15A is a front view of an alternative embodiment of the system shown in FIGS. 2 and 3.

FIGS. 15A and 15B depict an alternative embodiment of the system 10 in the form of a system 210. The system 210 comprises a manifold 212 having bosses 214 formed thereon for mounting the first spray nozzles 24*a* and, optionally, the second spray nozzle 24*b*. The manifold 102 is mounted upstream of an inlet bellmouth 216 that directs airflow to the inlet of rotating machinery such as the engine 11. A FOD screen 218 can be positioned between the manifold 212 and the inlet bellmouth 216 (only selected portions of the FOD screen are depicted in FIGS. 15A and 15B, for clarity).

The first and second spray nozzles 24*a*, 24*b* can be mounted on the manifold 102 using quick-connect fittings such as the quick-connect fittings 28. In particular, the female portion 32 of a quick-connect fitting 28 can be secured to each boss 214 by a suitable means such as welding. Respective male portions 30 of the quick-connect fitting 28 can be mounted on the first and second spray nozzles 24*a*, 24*b*. (The male portion 32 can be mounted on the boss 214, and respective female portions 32 can be mounted on the first and second spray nozzles 24*a*, 24*b* in alternative embodiments.)

As the FOD screen 218 is located between the first and second spray nozzles 24*a*, 24*b* and the inlet bellmouth 216, the system 210 does not include structures, such as the mounting bosses 18*a* or 18*b* of the system 10, that can help retain the first or the second spray nozzles 24*a*, 24*b* in the event the first or second spray nozzles 24*a*, 24*b* become liberated from their mounts during operation.

Figure 16A:
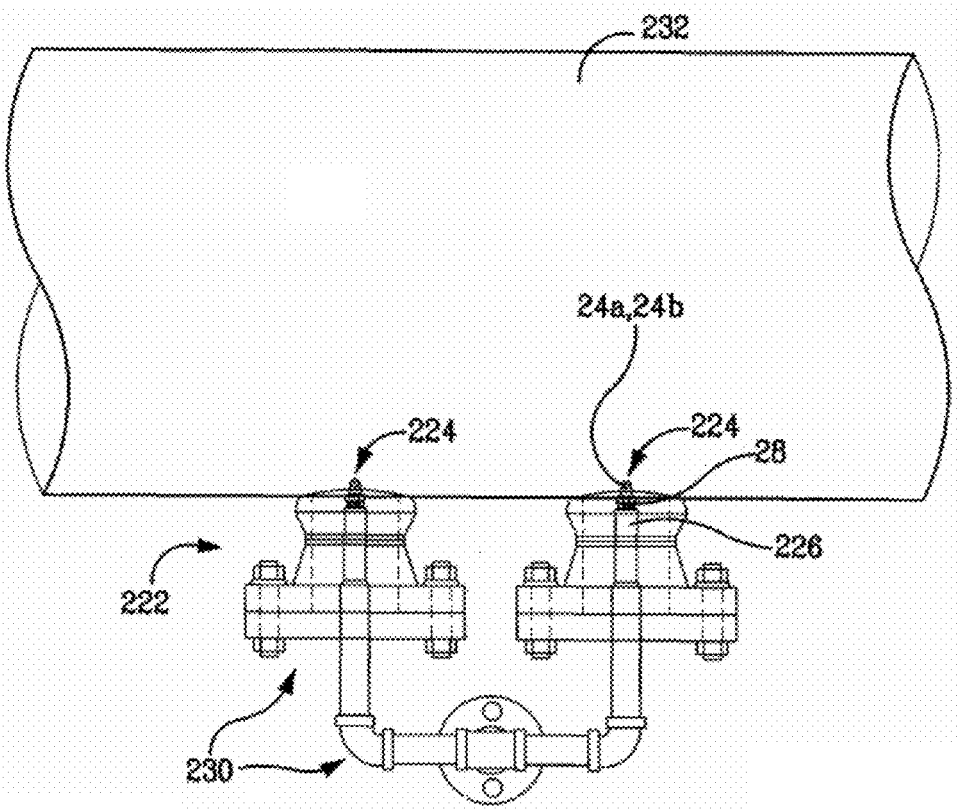
FIG. 16A is a side view of another alternative embodiment of the system shown in FIGS. 2 and 3.
Figure 16B:
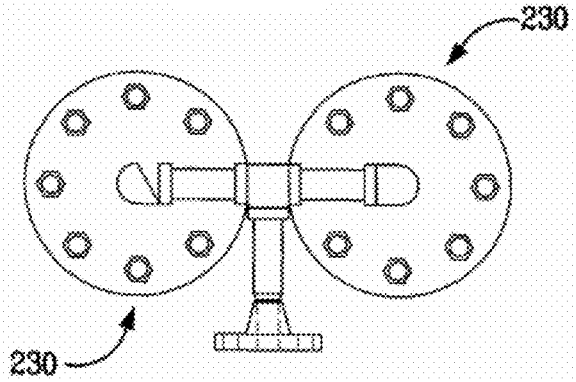
FIG. 16B is a front view of a manifold of the alternative embodiment shown in FIG. 16A.

FIGS. 16A and 16B depict another alternative embodiment of the system 10, in the form of a system 222. The system 222 comprises a plurality of nozzle assemblies 224. Each nozzle assembly 224 comprises a nozzle body 226, one of the first spray nozzles 24*a* and, optionally, one of the second spray nozzles 24*b*. The first and second spray nozzles 24*a*, 24*b* can be mounted on the associated nozzle body 226 using the quick-connect fittings 28. In particular, the female portion 32 of a quick-connect fitting 28 can be secured to each nozzle body 226 by a suitable means such as welding. Respective male portions 30 of the quick-connect fitting 28 can be mounted on the first and second spray nozzles 24*a*, 24*b*. (The male portion 30 can be mounted on the nozzle body 226, and respective female portions 32 can be mounted on the first and second spray nozzles 24*a*, 24*b* in alternative embodiments.)

Each nozzle assembly 224 is supplied with pressurized fluid by a manifold 230. The nozzle assemblies 224 can be positioned so that the tip of each spray nozzle 24*a*, 24*b* extends into an inlet plenum 232 by way of a respective hole formed in the inlet plenum 232. Each hole is large enough to permit the associated nozzle first and second 24*a*, 24*b* to discharge fluid into the airstream within the inlet plenum 232, and to permit the first and second nozzle 24*a*, 24*b* to be removed from the nozzle body 226. Each hole preferably is small enough, however, to prevent the first or second spray nozzle 24*a*, 24*b* from entering the airstream if the first or second spray nozzle 24*a*, 24*b* becomes liberated during operation.

What is claimed:

1. A system for introducing a liquid into an inlet structure, the system comprising:

a compressor including the inlet structure, the inlet structure configured to direct an inlet airstream into the compressor;

a set of nozzle assemblies configured to direct the liquid into the inlet structure, the nozzle assemblies elongate along a central longitudinal axis, each nozzle assembly having a nozzle body;

a first set of first spray nozzle tips, each of the first spray nozzle tips comprising an orifice sized to discharge liquid at a first flow rate, and each of the respective first spray nozzle tips configured to be coupled to the nozzle body;

a second set of second spray nozzle tips, each of the second spray nozzle tips comprising an orifice sized differently than the orifice of the first set of spray nozzle tips so that each of the second spray nozzle tips discharges liquid at a second flow rate different than the first flow rate, and each of the respective second spray nozzle tips configured to be coupled to the nozzle body;

a plurality of spray nozzle tip quick-connect fittings, each spray nozzle tip quick-connect fitting comprising a first portion coupled to a respective nozzle body, and a mating second portion configured to be coupled to a respective one of the spray nozzle tips in the first and second sets of spray nozzle tips, the mating second portion defining an outer surface that is spaced from the central longitudinal axis along a direction that is substantially transverse to the central longitudinal axis, each spray nozzle quick-connect fitting further including a biasing seal member disposed on the outer surface of the mating second portion, the biasing seal member configured to seal an interface defined between the first portion and the mating second portion;

whereby the first and second sets of spray nozzle tips are capable of being disconnected from the set of nozzle bodies without breaking any threaded or welded connection;

a manifold mounted proximate the inlet structure and configured to direct the liquid to the set of nozzle bodies;

a set of mounting bosses associated with the set of nozzle bodies, each mounting boss configured to mount its respective nozzle body onto the inlet structure of the compressor;

a plurality of nozzle body quick-connect fittings, each of the nozzle body quick-connect fittings comprising a first portion configured to be coupled to one of the respective nozzle body and a mating second portion configured to be coupled to one of the respective mounting bosses, whereby each nozzle body are configured to be disconnected from its respective mounting boss without breaking any threaded or welded connection;

whereby the spray nozzle quick-connect fittings and the nozzle body quick-connect fittings are configured such that the first spray nozzle tips can be readily replaced by the second spray nozzle tips on the same respective nozzle body such that the system can introduce the liquid via the second set of second spray nozzle tips into the inlet structure at the second flow rate.

2. The system of claim 1, further comprising a retainer mounted on each of the mounting bosses, each of the retainers capable of receiving and retaining a corresponding one of the first and second spray nozzle tips, each of the retainers having a through hole formed therein for facilitating discharge of liquid from the corresponding one of the first and second spray nozzle tips through the retainer.

3. The system of claim 1, wherein each of the nozzle body quick-connect fittings comprises a coupler having a plug, and a socket for removably receiving the plug, the socket comprising a body, a plurality of ball bearings disposed in holes formed in the body, and a collar mounted on the body so that the collar is movable between a first position wherein the collar urges the ball bearings into contact with the plug so that the plug is retained by the socket, and a second position wherein the ball bearings can disengage from the plug thereby allowing the plug to be removed from the socket.

4. The system according to claim 1, wherein the compressor is a centrifugal compressor.

5. The system according to claim 1, wherein the compressor forms a portion of a gas turbine engine.

6. The system according to claim 1, wherein the first portion of each of the nozzle body quick-connect fittings is coupled to its respective nozzle body by a compression fitting.

7. The system according to claim 1, wherein the second portion of each of the nozzle body quick-connect fittings is directly coupled to its respective mounting boss by a threaded connection.

8. The system according to claim 2, wherein each of the mounting bosses is substantially hollow, and wherein each of the retainers is mounted within its respective mounting boss.

9. A system for introducing a liquid into an inlet structure, the system comprising:

a compressor including the inlet structure, the inlet structure configured to direct an inlet airstream into the compressor;

a set of first spray nozzle assemblies configured to be coupled to the inlet structure, each of the first spray nozzle assemblies comprising an orifice having a first cross-sectional dimension such that the orifice is sized to discharge liquid at a first flow rate;

a set of second spray nozzle assemblies, each of the second spray nozzle assemblies comprising an orifice having a second cross-sectional dimension that is different than the first cross-sectional dimension such that the orifice is sized to discharge liquid at a second flow rate different than the first flow rate, each of the first and second spray nozzle assemblies elongate along a respective central longitudinal axis;

a manifold configured to direct liquid to either one of the set of first spray nozzle assemblies and the set of second spray nozzle assemblies;

a plurality of substantially hollow mounting bosses configured to mount either one of the set of first spray nozzle assemblies and the set of second spray nozzle assemblies onto the inlet structure of the compressor;

a retainer disposed in each of the mounting bosses, each retainer configured to receive and retain the spray nozzle assembly mounted on the respective mounting boss, each retainer defining a through hole extending therethrough, the throughhole sized to permit formed therein for facilitating discharge of liquid through the retainer;

a plurality of quick-connect fittings, each of the quick-connect fittings comprising a first portion coupled to one of the spray nozzle assemblies, and a mating second portion coupled to one of the mounting bosses, the mating second portion defining an outer surface that is spaced from the respective central longitudinal axis along a direction that is substantially transverse to the respective central longitudinal axis, each quick-connect fitting including a biasing seal member disposed on the outer surface of the mating second portion, the biasing seal member configured to seal an interface between the first portion and the mating second portion;

wherein each of the spray nozzle assemblies is substantially disposed within its respective mounting boss between one of the quick-connect fittings and one of the retainer.

10. The system according to claim 9, wherein each of the spray nozzle assemblies comprises a nozzle spray tip and a nozzle body, and wherein the first portion of each of the quick-connect fittings is coupled to a nozzle body, and further comprising a plurality of second quick-connect fittings, a first portion of each of the second quick-connect fittings coupled to a nozzle spray tip and a mating second portion of each of the second quick-connect fittings coupled to a nozzle body.

* * * * *